US006526902B1

(12) United States Patent
Faber

(10) Patent No.: US 6,526,902 B1
(45) Date of Patent: Mar. 4, 2003

(54) DRIVE-ON DRY DOCK

(75) Inventor: David T. Faber, Cleveland, OH (US)

(73) Assignee: Ocean Innovations, Inc., Fort Lauderdale, FL (US)

( * ) Notice: Subject to any disclaimer, the term of this patent is extended or adjusted under 35 U.S.C. 154(b) by 0 days.

(21) Appl. No.: 10/007,340

(22) Filed: Oct. 26, 2001

(51) Int. Cl.[7] ..... B63B 35/44
(52) U.S. Cl. ..... 114/263
(58) Field of Search ..... 114/263

(56) References Cited

U.S. PATENT DOCUMENTS

| | | | | |
|---|---|---|---|---|
| 3,951,087 A | | 4/1976 | Carson | |
| 3,967,570 A | | 7/1976 | Bradfield | |
| 4,072,119 A | | 2/1978 | Williams | |
| 4,104,082 A | | 8/1978 | Boujard et al. | |
| 4,482,268 A | | 11/1984 | Stevenson et al. | |
| 4,604,962 A | | 8/1986 | Guibault | |
| 4,641,595 A | | 2/1987 | Pritchett | |
| 4,660,495 A | * | 4/1987 | Thompson | 114/263 |
| 4,678,366 A | | 7/1987 | Williamson | |
| 4,808,028 A | | 2/1989 | White | |
| 5,016,551 A | | 5/1991 | Peck et al. | |
| 5,394,814 A | | 3/1995 | Rutter et al. | |
| 5,529,013 A | | 6/1996 | Eva, III et al. | |
| 5,931,113 A | | 8/1999 | Eva, III et al. | |
| 5,947,049 A | | 9/1999 | Elson | |

* cited by examiner

*Primary Examiner*—Stephen Avila
(74) *Attorney, Agent, or Firm*—Renner, Otto, Boisselle & Sklar, LLP

(57) ABSTRACT

A drive-on dry dock (10) especially suited for a boat (12) longer than about thirty feet and weighing more than about seven thousand pounds. The dock (10) includes a platform (14), a guide (16), and a lift (18). The platform (14) includes an aft section (20), a forward section (22), and a hinge section (24) therebetween. The guide (16) defines a path for movement of the boat (12) from the aft section (20) to a rest position whereat the boat's bow engages and is supported by the forward section (22). The lift shifts the platform (14) between a first condition in which the aft section is only buoyant enough to support itself and so can be downwardly flexed form a ramp for the boat (12) and a second condition in which the aft section is sufficiently buoyant to lift the boat out of the water.

24 Claims, 8 Drawing Sheets

DRIVE-ON DRY DOCK

FIELD OF THE INVENTION

This Invention relates generally to a drive-on dry dock and, more particularly, to a drive-on dry dock which is especially suited for a boat longer than about thirty feet and weighing more than about seven thousand pounds.

BACKGROUND OF THE INVENTION

A drive-on dry dock is used to store a boat out of the water to minimize problems of corrosion, marine growth, and leakage. Of particular relevance to the present invention is a drive-on dry dock for larger-sized watercraft, such as a boat which is longer than about thirty feet and weighs more than about seven thousand pounds. In designing a drive-on dock for such a craft a number of factors must be taken into consideration. First, its center of gravity is usually substantially rearward of the geometrical center of the craft. In addition, care must be taken to assure that the motors' cooling water inlets are kept submerged during the drive-on procedure.

In the past, dry docks for the boats of this size have included a rigid framework including hull-supporting bunks and inflatable pontoons which lift the framework between a first position and a second position. In the first position, the framework is submerged so that the boat can be driven over it while afloat. The framework is then moved to the second position where it is substantially horizontal and above the mean water level so that the boat is lifted out of the water. Inflatable tanks have been used to provide the necessary lift, and the rigid framework is kept approximately horizontal by a linkage mechanism between the framework and a supporting frame such as a dock. In these systems the boat's motors are not normally running during the lifting procedure. The mechanical linkage assures that the boat is lifted horizontally even though its weight is concentrated in the rear.

SUMMARY OF THE INVENTION

The present invention provides a drive-on dry dock for large sized craft, e.g., longer than about thirty feet and weighing more than about seven thousand pounds, and a method of dry-docking such a craft.

More particularly, the present invention provides a drive-on dry dock comprising a partially submersible platform, guide surfaces on the platform to position a boat or a watercraft on the dock, and a lift to elevate the submerged part of the dock on command. The platform includes an aft section and a forward section that are transversely hinged together. The guide surfaces define a path for movement of the boat from the aft section of the dock to a rest position in which the boat's bow engages and is supported by the forward section of the dock. The lift shifts the platform between a first state and a second state. In the first state, the top surface of the forward section of the dock is generally planar and mostly above the mean water level, and the aft section may also have its top surface above the water. In the first state, the aft section is only slightly more than neutrally buoyant and it can easily be pressed downward by the bow of an approaching boat which then may be driven along the path to its rest position. In the second state, the top surface of the aft section is above the mean water level and the craft is out of the water. The hinging between the aft section and the forward section can be accomplished by including a hinge section in the platform between the forward and aft sections of the dock.

The platform can be formed from a plurality of dock units assembled together to form the aft section, the forward section, and the hinge section. The dock units include buoyant units and non-buoyant units, with at least some of the non-buoyant units being positioned in the aft section. The buoyant units have a sealed, air-filled body, and the non-buoyant units have a similar body with openings so that they can fill with water. Selective use of buoyant and non-buoyant units makes it possible to achieve any desired buoyancy in any of the dock sections. When making the platform, a plurality of buoyant units can be assembled together, and then the bodies of selected units may be perforated as required to convert them to non-buoyant dock units.

The dock units are laid out in a rectangular array formed from a series of transverse rows of buoyant units. The length of each row (and hence the width of the resulting dock) is determined by the particular boat for which it is intended, as is the number of rows (and hence the length of the dock). The units are connected to each other by flexible joints which allow the various units to bend or hinge to various degrees with respect to their immediate neighbors as described in U.S. Pat. No. 5,529,013. Overall, the units are arranged so that the forward section remains generally flat and with its top above water, the hinge section can flex, curving downward from the plane of the top of the forward section. The aft section is made rigid by the lift means. The dock is constructed so that in a first state (with the lift means providing no lift) the aft section is only slightly more than neutrally buoyant. In a second state (with the lift means providing lift). The aft section has sufficient buoyancy to support the boat completely out of the water.

At this point, for ease of description, it may be helpful to establish terminology for use in this application. "Longitudinal" means parallel to the long direction of the dock, e.g., from fore to aft. "Transverse" means from side to side, e.g., from starboard to port. Bending is described using the same words. Bending is "transverse" when the port and/or starboard edges are higher and/or lower than the center with the result that traversing the dock along a transverse line follows a curve, while traversing the dock along a longitudinal path traces a straight line. Similarly, bending is longitudinal when the aft or fore end of the dock is raised and traversing the dock longitudinally traces a curve while traversing it along any transverse path traces a straight line.

It is desirable to limit transverse flexing of the dock. This keeps the flexible joints between any two rows coaxial and so promotes the desirable longitudinal flexing. To this end transverse beam structures are mounted in the seams between some of the transverse rows of dock units. The preferred beam structure is non-buoyant and includes a beam (e.g., an inverted T-beam) having a web extending into one of the transverse seams. Other beams can be attached to the inverted T-beam and these other beams can be used to mount the lift components (e.g., to form cradles for pontoons). A transverse beam structure can be positioned at each end of the hinge section and a plurality of transverse beam structures can be positioned intermittently throughout the aft section.

The lift for the dry dock can comprise a pair of inflatable devices, particularly pontoons, positioned below and on either side of the path defined by the guide surfaces. The pontoons each have an air tight inner wall which can be selectively connected to a source of air under pressure or vented to the atmosphere, and a corrugated outer wall surrounding the inner wall.

These and other features of the invention are more fully described and particularly pointed out in the claims. The following description and annexed drawings set forth in detail certain illustrative embodiments of the invention, these embodiments being indicative of but a few of the various ways in which the principles of the invention may be employed.

DRAWINGS

DETAILED DESCRIPTION

Figure 1A:
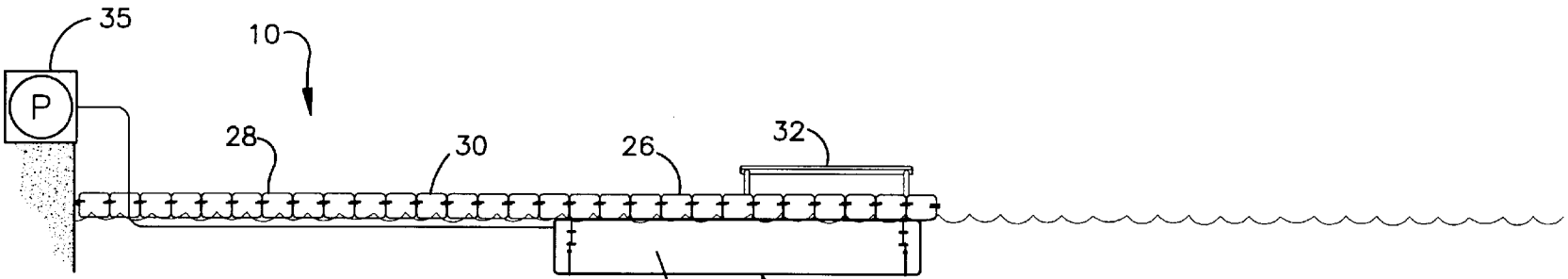
FIGS. 1A–1D are schematic drawings of a dry dock according to the present invention with a boat being shown driven onto the dock and then lifted out of the water.

Referring now to the drawings, and initially to FIGS. 1A–1D, a dry dock 10 according to the present invention is shown with a boat 12 being docked on it. The dock 10 is especially suited to accommodate a relatively large pleasure craft having a sternward center of gravity. For example, the boat 12 can be longer than about thirty-eight feet and weigh more than about twelve thousand pounds. The dock is especially suited for boats between about thirty feet and fifty feet and weighing from about seven thousand to twenty thousand pounds.

The dock 10 comprises a platform 14 fitted with guide surfaces 16 (FIGS. 2 and 3) which guide a boat onto the dock and a lift 18 (FIG. 1) in the form of pontoons 34 which are inflated once the boat is on the dock. For discussion purposes the platform 14 may conveniently be divided into an aft section 20 and a forward section 22 connected to each other by an intermediate hinge section 24. The sections 20, 22 and 24 include top surfaces 26, 28 and 30, respectively, which together define the deck of the platform 14.

The guide surfaces 16 define a path of movement from the aft section 20 to the forward section 22 so that the boat 12 can be driven onto the aft section 20 (FIG. 1B) until its bow engages the flexible section 24 and ultimately reaches a rest position where it engages and is supported by the forward section 22 of the dock 10. (FIGS. 1C and 1D.) In the illustrated embodiment, the guide surfaces 16 (FIG. 2) extend from the aft end of the dock 10 forward the length of the aft section 20 and the hinge section 24 of the dock on opposite sides of a central groove 31 (FIG. 3) formed in the surface of the dock. Guide surfaces 16 are made of a flexible smooth material (such as HDPE pipe) so that the boat can slide along the guide surfaces without scratching its hull. The dock may also include two or more appropriately positioned bunks 32 (FIGS. 2 and 3) mounted on the aft section 20 which gently engage and support the hull of the boat 12. The shape, size, location and mounting of the bunks 32 will vary depending upon the hull design of the boat 12.

The lift 18 is in the form of a pair of pontoons 34 which are selectively inflatable by a fluid source 35 to change the dock 10 from a first state where the aft end is readily submerged and second state with greatly increased buoyancy in the aft end. In the illustrated embodiment, the pontoons 34 extend the length of the aft section 20 but stop short of the hinge section 24. The pontoons are positioned on opposite sides of the path defined by the guides 16. While tubular pontoons are illustrated, the lift 18 could utilize other devices for providing buoyancy. For example, properly supported flexible bladders could be used. A sufficient number of docking units with appropriate air inlets and water outlets could also be used.

In addition, although a pair of pontoons 34 are shown symmetrically located under opposite sides of the keel are shown, other arrangements are possible. For example, a single centrally located pontoon could be used, or three or more pontoons could be used. The number of pontoons required is determined by the weight of the craft to be driven onto the dock.

When the platform 14 is in its initial position (FIG. 1A), it is ready for the boat 12 to be driven on. In this position, all three sections 20, 22 and 24 of the dock lie flat on the water. The pontoons are filled with water so the aft section 20 is only slightly buoyant. Accordingly, all the top surfaces 26, 28 and 30 are at or above the mean water level.

Figure 1B:
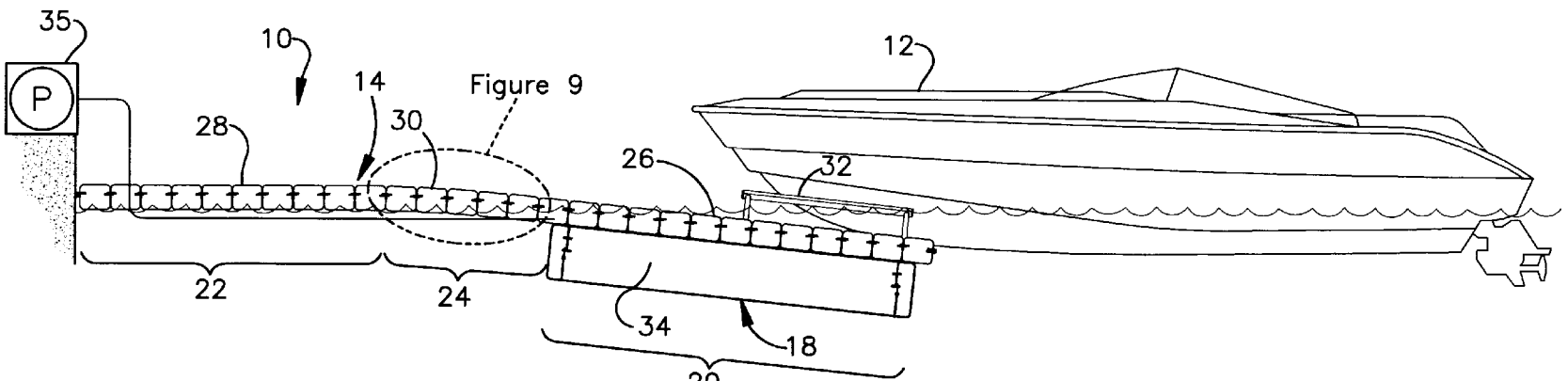
Figure 1C:
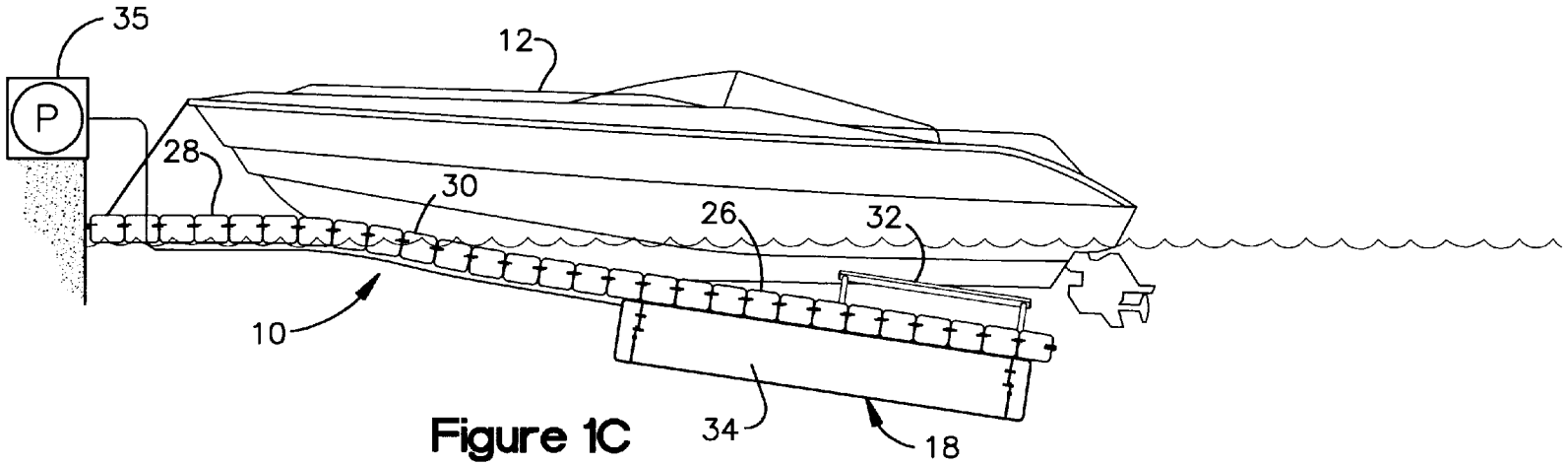
Figure 1D:
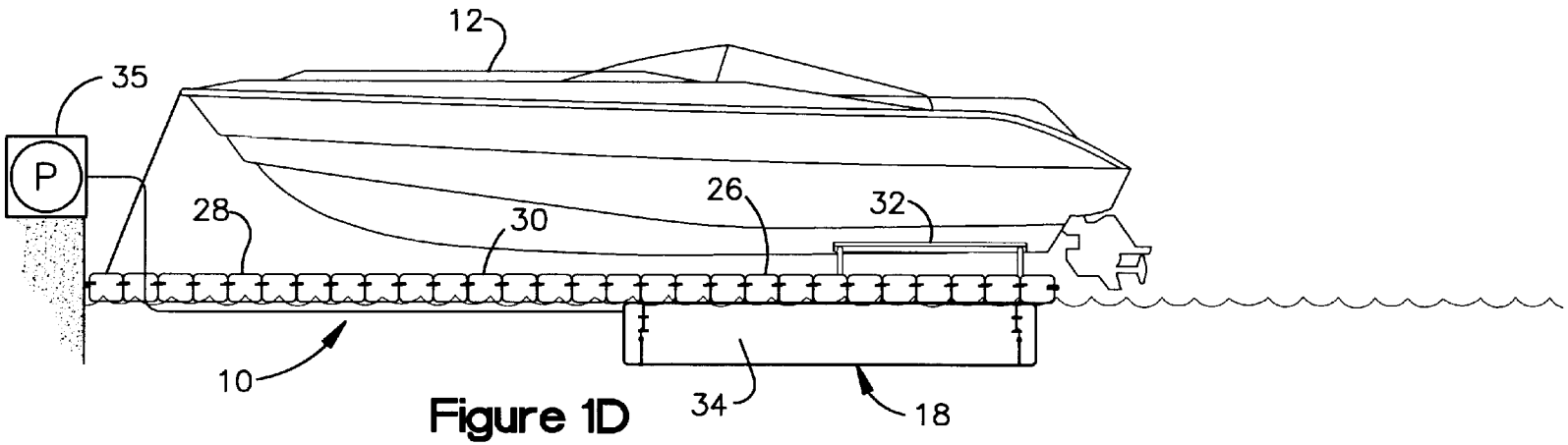

As the boat 12 is driven onto the dock 10, the aft section 20 is pressed downward (FIG. 1B). Because most of the boat's weight is toward its stern and the aft section 20 of the dock 10 is easily submerged, there is little difficulty driving the boat 12 until its bow is in its intended rest position (FIG. 1C). Indeed, during the design and installation of the dock 10, the buoyancy of the aft section 20 of the dock is adjusted to guarantee that this is true. This adjustment is made by boring holes as required in dock units 40 and 42 in the aft section 20 to reduce that section's buoyancy.

When the bow of boat 12 is in its final or rest position up on the dock 10 but before lifting the boat's stern (FIG. 1C), the stern of the boat, including its propeller, is still in the water. Further, the engine cooling water intake (not shown) whose position varies from boat to boat is also still submerged. The buoyancy of the dock units is adjusted to assure this result.

At this point, a bow line 37 can be attached to the bow of the boat 12 to keep it from slipping backwards. FIG. 1C. Then air is pumped into the pontoons 34 to lift the aft dock section 20. When the platform 14 is in its final or rest position, the aft section 20, the forward section 22, and the hinge section 24 are again generally coplanar and above the mean water level. (FIG. 1D.) Thus, the craft 12 is lifted out of the water and dry docked.

The platform 14 (FIG. 2) is formed from a plurality of dock units 40 and 42 assembled together in a rectangular grid or array. In the illustrated embodiment, the dock 10 is formed from a series of twenty-eight transverse rows each of which is nine units wide. Eight longitudinal seams 44 extend between the nine columns and twenty-seven transverse seams 46 extend between each of the twenty-eight rows. (Only a few transverse seams are numbered in FIG. 2.) The number and width of the rows depends on size and shape of the particular boat for which the dock is to be used.

The dock units 40 (FIGS. 4 and 5) and 42 (FIG. 6) can be made of any suitable waterproof material which provides a proper balance between flexibility and stiffness. For example, they can be made (e.g. molded) from a synthetic resin such as High Density Polyethylene (HDPE) which is extremely rugged, and resists corrosion and attachment of marine flora and fauna. Such dock units are well known, and similar dock units are shown in U.S. Pat. Nos. 3,824,644; 4,604,961; and 5,529,013.

The dock units 40 are flotation units which provide both buoyancy and structure to the dock 10. The dock units 42 do not provide any buoyancy and are used as structure units in the matrix to connect between the flotation units 40. In the illustrated embodiment, the non-buoyant units 42 are located exclusively in the aft section 20 and assure the desired buoyancy when the dock is in the first state, namely buoyant enough to float, but not buoyant enough to support a load.

Figure 4:
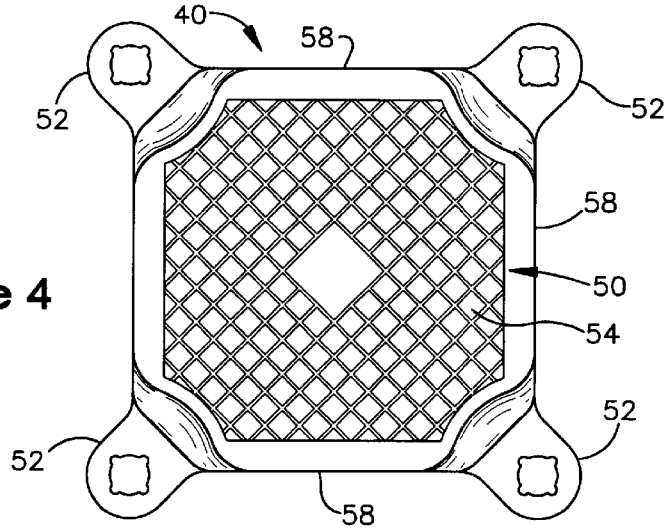
FIG. 4 is a plan view of a dock unit used to make the dock of FIG. 2.
Figure 5:
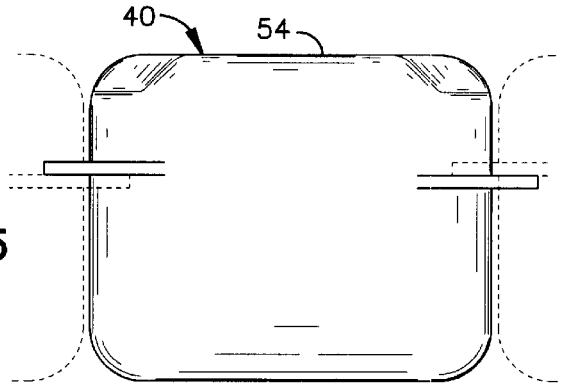
FIG. 5 is an elevation view of the dock unit of FIG. 4.

As shown in FIGS. 4 and 5, each dock unit 40 comprises a sealed hollow body 50 filled with air to provide the desired buoyancy and tabs 52 for attachment of the units 40 together. In the illustrated embodiment, the body 50 has a roughly cubic geometry formed from a top wall 54, a bottom wall 56, and four side walls 58 each having a roughly square shape of approximately the same size. The unit has four tabs 52 which extend diagonally outward from each of the corner edges between the sidewalls 58. In practice the dock units have been made which are approximately 20 inches×20 inches×16 inches tall. Each unit 40 has the ability to support about two hundred pounds (200 lbs.).

Figure 2:
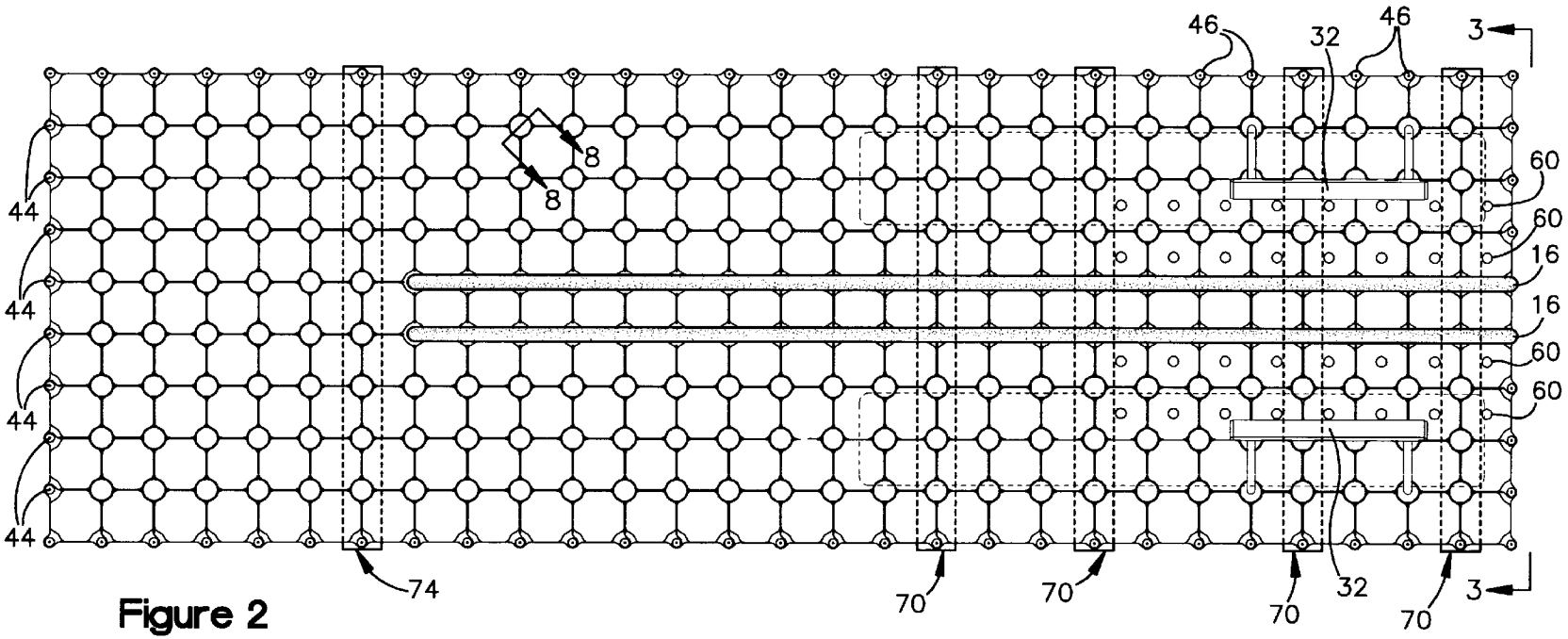
FIG. 2 is a plan view of a dock of the present invention.
Figure 6:
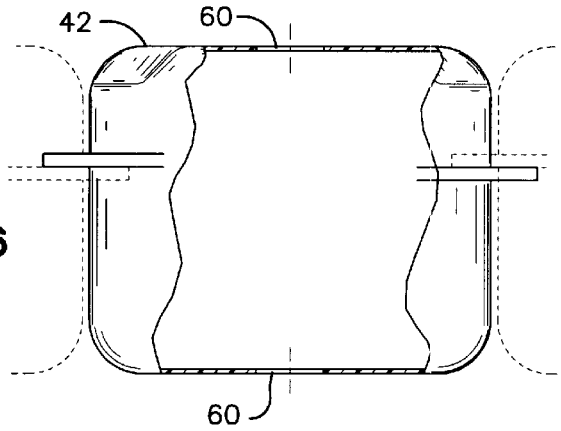
FIG. 6 is an elevation view of a dock unit generally similar to that in FIG. 4, but made non-buoyant and shown partly in section.

As shown in FIG. 6, the dock units 42 are essentially identical to the dock units 40, and accordingly like reference numerals are used. The dock units 42 differ from the dock units 40 only in that each dock unit 42 includes an opening 60 in its top wall 54 and another in its bottom wall 56. As a result, water will fill the hollow interior of the body 50, making the unit non-buoyant. While any non-buoyant dock unit could be used to obtain the desired submersion of the aft section 20, the use of the illustrated "perforated" dock units 40 has certain design advantages. Specifically, a few (or no) non-buoyant units 42 can initially be provided in the matrix, and then additional flotation units 40 may be perforated as necessary to achieve the desired submersion/flotation balance. (FIG. 2 shows the openings 60 in the tops of the dock units 42, although only 4 of 32 such openings have referenced numerals.)

The dock units 42 may also be used as counter weights to adjust the total buoyancy of any particular part of the dock or of the dock as a whole. This can be done by allowing a dock unit 42 to fill with a desired amount of water and then plugging the hole in the bottom. By selective perforation or filling and plugging of dock units 40, 42, the dock can be made flat when the pontoons 34 are fully inflated.

Figure 3:
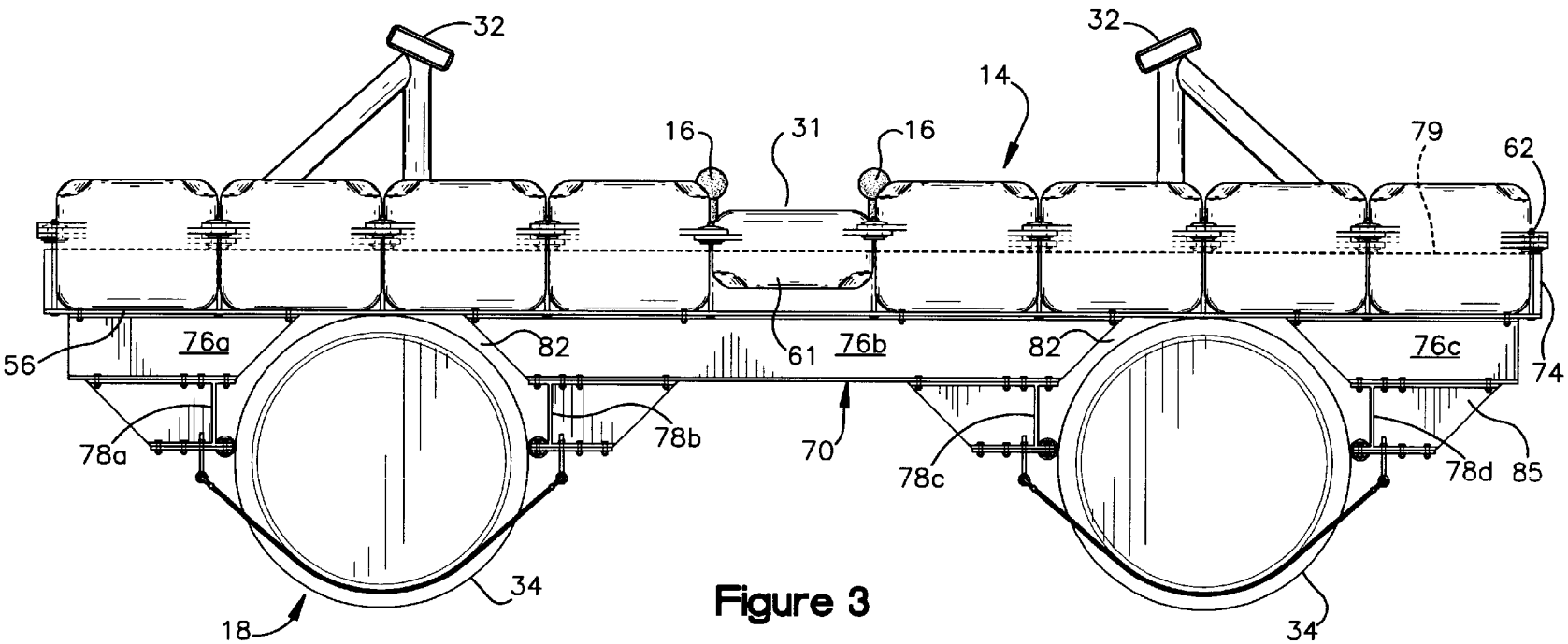
FIG. 3 is of FIG. 1 view looking in the direction of arrows 3—3 of FIG. 2.
Figure 7:
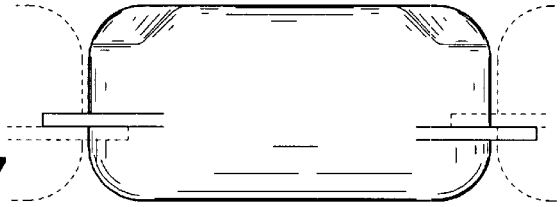
FIG. 7 is a section view of a short dock unit.

In addition to the dock units 40 and 42, shorter dock units 61 as illustrated in FIG. 7 are also used. These units 61 are the same in plan view as the units 40, but their sidewalls are shorter (only about 10 inches) and are shown right side up in FIG. 7. The shorter dock units 61 are used in an inverted position as the center unit in each row of the aft and hinge sections 20 and 24 of the dock 10. (In the aft most row of the aft section 20, a roller may be used instead of the inverted short unit.) The inverted short units 61 form and define the recess 31 (FIG. 3).

Figure 8:
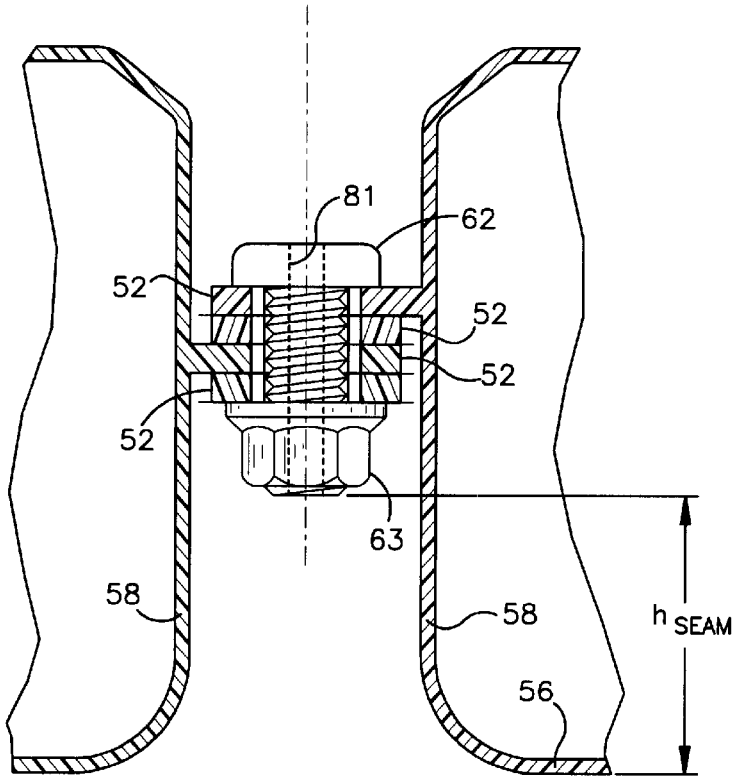
FIG. 8 is side view of the connection of dock units together.

FIG. 8 illustrates the connection between the units 40, 42 and 61 in detail. Corner tabs 52 from each of four neighboring units 40, 42 and 61 are stacked one on top of the other at a four-way intersection. A suitable fastener 62, e.g., a plastic, preferably nylon, bolt is passed through aligned openings in the corner tabs 52 and secured with a nut 63, again preferably nylon. The holes in the tabs are located so that a gap, about ½ to ¾ inch, is left between the side walls 58 of adjacent units, so long as the units are all coplanar. Thus, at each corner where four units meet, there is a cross shaped gap when viewed from above. The gaps 64 and 66 (FIG. 9) are created above and below, respectively, the fasteners 62. The gaps 64 and 66 from adjoining units together form the top and bottom portions, respectively, of the transverse and longitudinal seams (FIG. 2) with the tabs spanning the seams. It may be noted for future reference that a distance $h_{seam}$ (FIG. 8) exists between the bottom wall 56 and the bottom of the fastener 62 and that the gaps 64 and 66 have a width of about $w_{seam}$. (FIG. 9)

The top walls 54 of the units 40 and 42 (FIGS. 3–5) form the top surfaces 26, 28 and 30 of the sections 20, 22, and 24 of the platform 14 (FIG. 2). It is usually desirable that these top surfaces 26, 28, and 30 be more or less flat without any abrupt steps or dips. To this end, the corner tabs 52*a*, 52*b*, 52*c* and 52*d* are positioned different distances $d_a$, $d_b$, $d_c$ and $d_d$ from the top wall 54. (FIG. 4.) By staggering these distances, the tabs 52 can be appropriately located to make the platform's upper surface generally coplanar as is known in the art. In addition, instead of using fasteners 62, fasteners with heads that are substantially flush with top walls 54 may be used where a flat deck is desirable. Such fasteners are shown in U.S. Guibault Pat. No. 4,664,962.

Figure 9:
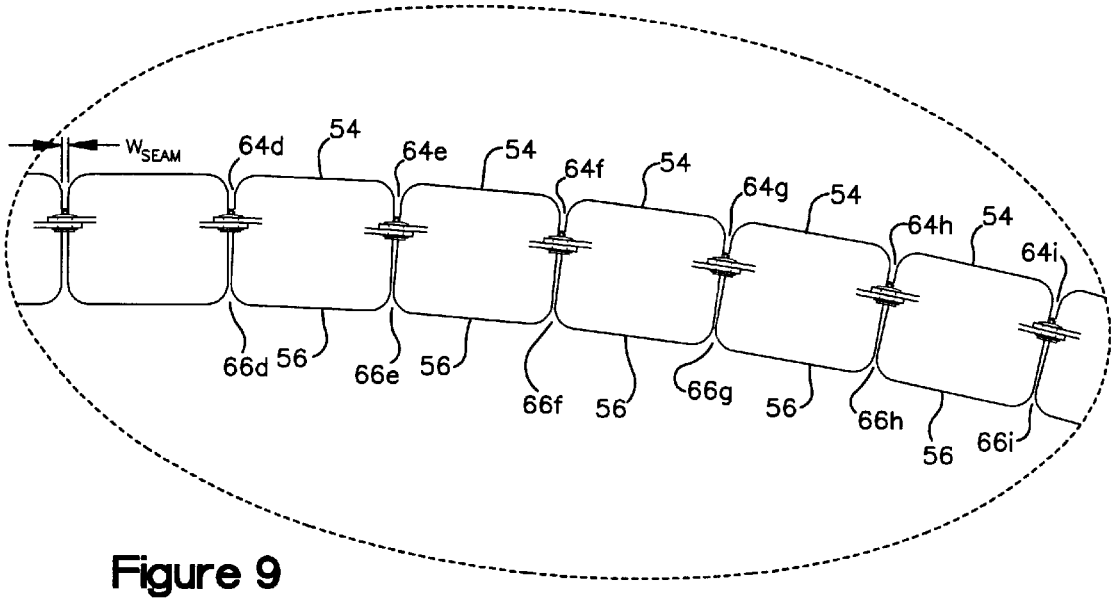
FIG. 9 is a schematic side view of dock units in a flexed condition.

As shown in FIG. 9, the gaps 64 and 66 above and below the tab connection allow the units 40 and 42 to flex when a downward force is applied to the aft section 20 of the platform 14. The downward force may be applied by the boat as shown in FIGS. 1B and 1C. As discussed above, the buoyancy of the aft section 20 is adjusted by the selective use of non-buoyant dock units 42, with the goal of making the aft section only slightly more than neutrally buoyant. As a result when no load is applied, the aft section 20 floats with its top surfaces out of the water, and when a boat is driven onto the dock, the aft section is easily submerged.

During flexing (FIG. 9), top walls 54 of longitudinally adjacent units 40 and 42 pivot away from each other, thereby opening the gaps 64 d, e, f, g, h and i, and the bottom walls 56 of longitudinally adjacent units 40 and 42 pivot toward each other thereby closing the gaps 66 d, e, f, g, h and i. This selective pivoting of the units toward/away from each other allows the hinge section 24 to flex curving downwardly so that the aft section 20 can form a ramp for the boat 12 (FIGS. 1B and 1C).

While longitudinal flexing is necessary for the hinge section 24 to perform its intended purpose, transverse flexing 46 is undesirable and can be detrimental to the functionality of the dry dock 10. Particularly, transverse flexing of the platform 14 can make it difficult, if not impossible, for the required longitudinal flexing to occur during loading of the boat 12. Transverse flexing can be reduced in a number of ways. As noted above, U.S. Pat. No. 5,931,113 discloses a beam which is formed from flotation units which can add transverse stiffness as well as buoyancy. For a craft the size for which the present invention is intended, such a beam may not be stiff enough to limit transverse bending sufficiently. The present invention provides a metal beam assembly 70 (FIG. 3) to stiffen the dock against transverse bending.

The transverse beam assembly 70 is incorporated into the platform 14 to support the pontoons 34 and to limit transverse flexing. As shown in FIG. 3, the transverse beam assembly 70 includes an inverted T-beam 74, I-beams 76*a*, 76*b* and 76*c* and I-beams 78*a, b, c,* and *d*. These beams are formed of a suitable metal, such as aluminum, having mechanical properties, characteristics and a cross section to hold the dock 10 substantially flat in the transverse direction during the docking process.

The inverted T-beam 74 extends the width of the platform 14 and has a web height approximately equal to $h_{seam}$ and a web thickness approximately equal to $w_{seam}$. When the beam 74 is placed in a seam, the top end 79 of the web of the beam 74 just reaches the lowest most part of the fastener 62 (FIG. 3). Its flange is then positioned flush with the bottom walls 56 of the units 40 and 42.

Figure 10:
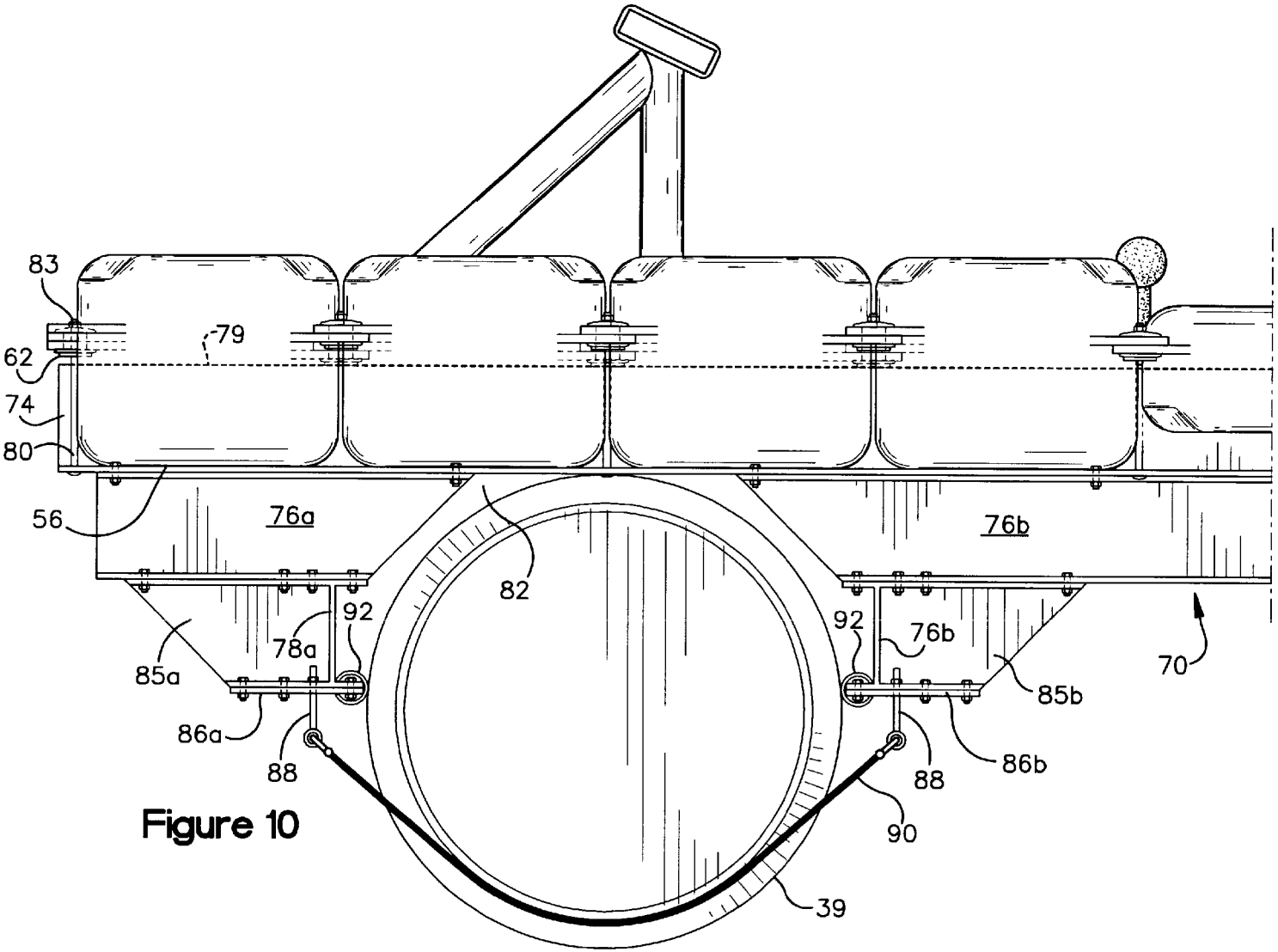
FIG. 10 is side view of a beam structure used to limit the transverse flexing.

The T-beam 74 is fastened to the dock 10 at several locations along its length and at each end. Typically, the beam 74 is fastened to about every other fastener 62 across the width of the dock 10. The arrangement shown on the left hand end of the beam 74 in FIG. 10 is typical. A bolt (or other suitable fastener) 80 extends through an opening in the flange of T-beam portion 74 and through an axial bore 81 in the aligned inter-tab fastener 62. The bolt 80 is preferably formed of stainless steel. When a nut 83 is tightened, the top 79 of the web of the T-beam 74 is pulled tight against the bottom of the fastener 62 and the flange of the T-beam is pulled tight against the bottom of the dock units 40 and 42. When so secured to the dock units, the beam assembly 70 provides substantial stiffness to resist transverse bending.

Transverse beam assemblies 70 can be mounted intermittently throughout the aft section 20, and a simple inverted T beam 74 is mounted in the forward section 22. If a beam is mounted in the hinge section 24, it inhibits bending about the seam in which it is located. In some docks, depending on the boat size, this may be acceptable.

In the embodiment illustrated in FIG. 2, the beam assemblies 70 are mounted in the first, fourth, eighth, and eleventh transverse seams 46 in the aft section 20 (counting from the aft end of the dock 10), and inverted T beam 74 is mounted in the transverse seam 46 separating the forward section 22 and the hinge section 24. While the exact location of the beam assemblies 70 depends on the weight and weight distribution of the particular boat for which the dock is intended, it is important that there be at least one beam assembly toward the fore and one beam assembly toward the aft of the aft section 20 of the dock 10. These provide mounting points for the pontoons 34.

The at least beam two assemblies 70 in the aft section 20 provide a foundation for mounting the pontoons 34. To this, end segments of I-beam 76*a*, 76*b* and 76*c* (FIG. 3) have appropriately placed slanted edges to form cradles 82 for the pontoons 34, and are bolted to the flange of the T-beam 74. Accordingly these I-beam segments extend transversely, and they are positioned to define in the spaces between them cradles 82 for the pontoons 34.

To further stabilize the pontoons 34 a pair of longitudinal I-beams 78*a, b, c,* and *d* are secured on opposite sides of each pontoon. See FIG. 10. The I-beams 78 are turned sideways relative to the beams 74 and 76 so that they extend longitudinally and are positioned are either side of the cradles 82 with their inner lower edges engaging the pontoons 34. Each of the I beams 78 extends about 12–18 inches along the length of a pontoon 34. The space between pairs of I-beams 78, e.g. pair 78*a, b, c,* and *d* are selected to match the pontoon diameter. When larger diameter pontoons 34 are used, the longitudinal I-beams are moved farther apart.

To stabilize the longitudinal I-beams 78 against transverse movement a reinforcing I-beam portions 85*a* and 85*b* (aligned with the beam portions 76) are secured next to the outer I-beam piece 78*a*, and reinforcing plates 86*a* and 86*b* are secured to the bottom of the I-beam pieces 78*a* and 78*b* and the I-beam portions 85*a* and 85*b*. A fastening member 88 (e.g., an eye bolt) is attached to each I-beam piece 78. A cable 90 formed of a woven nylon strap is secured at each end to a bolt 88. The cable 90 wraps around the pontoon 34 to secure it to the platform 14, and a tubular bumper 92 can be placed around the inward edges of the I-beam pieces 78 and the plates 86 to prevent distress to the pontoon 34.

Figure 11:
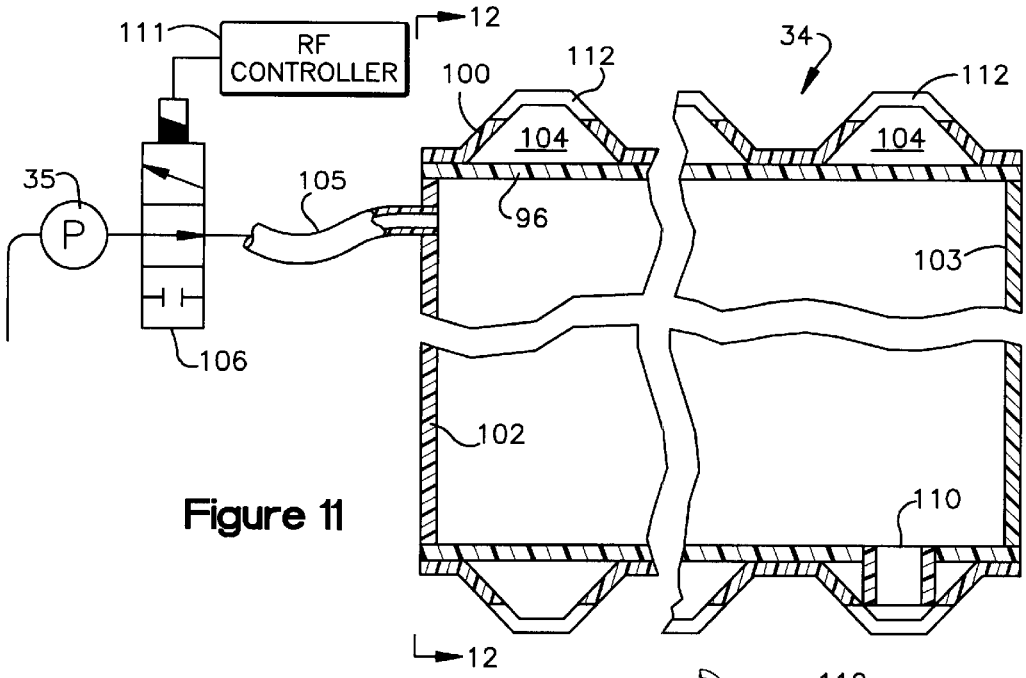
FIG. 11 illustrates a preferred pontoon structure and the equipment for controlling its buoyancy.
Figure 12A:
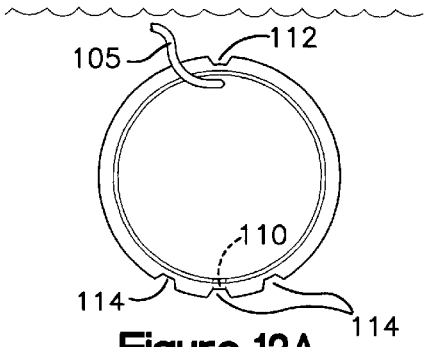
FIGS. 12A–12D are sequential views looking in the direction of arrows 12—12 in FIG. 11 and show the operating sequence in which a pontoon structure is initially submerged (FIG. 12A), is filled with air (FIG. 12B), so that it floats (FIG. 12C), and is then submerged again by allowing air out and water in (FIG. 12D).
Figure 12B:
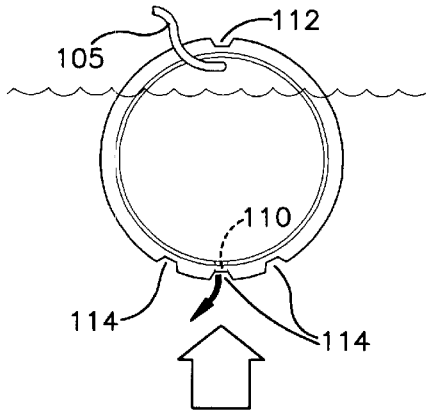
Figure 12C:
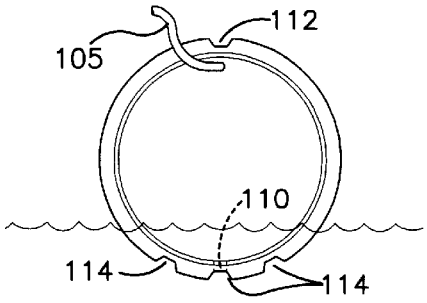
Figure 12D:
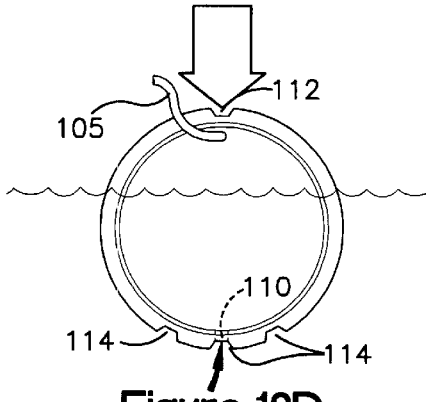

Referring now to FIG. 11, one of the pontoons 34 of the lift 18 for the dry dock 10 is shown. The pontoon 34 comprises an inner tubular wall 96 forming an inner cylindrical inflation cavity 98, and a corrugated outer tubular wall 100 forming the pontoon's outer surface. A series of annular chambers 104 are formed between the inner and outer walls. Disc-shaped walls 102, 103 form the axial ends of the pontoon 34. The inner cavity 98 is connected to fluid source (e.g., air pump 35) through a flexible conduit 105 so that it can be selectively inflated/deflated by control of a valve 106.

The pontoons 34 can be made of plastic sewer pipe that is commercially available in different diameters (e.g., 30 inches and 36 inches) and in suitable lengths (e.g., twenty feet). In such a sewer pipe, the inner wall 96 is formed from a seamless parisan, and the radially inner edges of the corrugated outer wall 100 are melt-bonded to the inner wall 96 in a blow-molding process. To form the pontoons the disk shaped end walls 102 and 103 are welded to the sewer pipe to form a permanent, watertight and airtight joint. Each end wall 102 and 103 has a single opening. The forward end wall 102 has an opening 108 near its top to which the air hose 105 is connected. When the valve 106 is in the position shown in FIG. 1, air from the pump 35 enters the conduit, passes through the opening 108 and enters the chamber 98. An outlet opening 110 is formed in the bottom of the pontoon 34 near the end wall 103. As air is pumped in to chamber 98, the water within the chamber 98 is displaced and exits through opening 110. The opening 110 is made large enough that it is unlikely to clog with any material or marine life that may be drawn into the inflation chamber 98.

Once enough air has been pumped into the pontoons 34 to lift the dock as desired, the valve 106 can be shifted to a closed position where all air flow is blocked. To lower the dock, the valve 106 is shifted to a third position in which air from the pontoons 34 is vented to the atmosphere.

Operation of the valve 106 maybe manual. However, it is also possible to use a radio frequency (RF) controller 111, like a garage door opener, to activate the valve 106 and pump 35. Further, an additional valve may be provided to control separately the amounts of air in each pontoon 34 to maintain trim where the boat is not evenly balanced port to starboard.

The outer wall 100 of the pontoon 34 forms a physical barrier which protects the inner wall 98. For example, a rotating propeller striking the outer wall 100 will be deflected before damaging or breaching the inner wall 98. However, if the annular chambers 104 are filled with air, they would provide buoyancy which would make the pontoon 34 difficult to submerge. To eliminate this buoyancy, outer annular chambers 104 are each provided with a top vent opening 112 (at twelve-o-clock position in FIG. 12), and lower vent/drain openings 114 (at four-thirty, six, and seven-thirty position). These openings can be formed by appropriately-placed saw cuts or slits in the outer wall 100, and they allow water to flow into and out of the chambers 104 as the pontoons are raised or lowered.

One can now appreciate that the present invention provides a dry dock 10 which can accommodate a large scale water craft without complicated linkages or other mechanisms. Although the invention has been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

What is claimed is:

1. A drive-on dry dock especially suited for a boat longer than about thirty-eight feet and weighing more than about twelve thousand pounds; said dock comprising:

a platform including an aft section and a forward section;

guide surfaces on the platform defining a path for movement of the boat from the aft section toward the forward section;

the guide surfaces defining a rest position in which the boat's bow engages and is supported by the forward section of the dock;

the forward section and the aft section being hinged together relative for movement about an axis transverse to the path; and a lift which moves the platform between a first position in which a top surface of the forward section is generally coplanar and substantially above the mean water level and the aft section is displaced downward with its top surface being submerged as the boat is driven along the path to the rest position, and a second position in which the top surface of the aft section is above the mean water level and the boat is out of the water.

2. A drive-on dry dock as set forth in claim 1, wherein the platform comprises a plurality of dock units assembled together to form the aft section and the forward section.

3. A drive-on dry dock as set forth in claim 2, wherein the dock units include buoyant units and non-buoyant units.

4. A drive-on dry dock as set forth in claim 3, wherein at least some of the non-buoyant units are positioned in the aft section.

5. A drive-on dry dock as set forth in claim 4, wherein each dock unit comprises a body and tabs extending from the body for attachment of the units together; wherein the body of the buoyant dock units is sealed and filled with air and wherein the body of the non-buoyant dock units has an opening for entry of water therein.

6. A method of making the drive-on dry dock of claim 5, comprising the steps of:

assembling together a plurality of the buoyant dock units to form the platform; and perforating selected buoyant dock units to form non-buoyant units.

7. A drive-on dry dock as set forth in claim 2, wherein the platform further comprises a hinge section between the aft section and the forward section together and wherein the plurality of dock units assembled also form the hinge section.

8. A drive-on dry dock as set forth in claim 2, wherein the dock units are assembled in longitudinal rows and transverse rows, wherein longitudinal seams extend between each of the longitudinal rows and transverse seams extend between each of the transverse rows, and wherein at least some sections of the platform are longitudinally flexible.

9. A drive-on dry dock as set forth in claim 8, wherein the platform further comprises a transverse beam structure to limit transverse bowing of the aft section along the transverse seams.

10. A drive-on dry dock as set forth in claim 9, wherein the transverse beam structure is non-buoyant and includes a beam having a flange extending into one of the transverse seams.

11. A drive-on dry dock as set forth in claim 10, wherein the beam portion is an inverted T-beam.

12. A drive-on dry dock as set forth in claim 11, wherein the lift comprises a pair of selectively inflatable devices mounted in cradles below and connected to the inverted T-beam.

13. A drive-on dry dock as set forth in claim 9, wherein the platform further comprises a hinge section between the aft section and the forward section and wherein a transverse beam structure is positioned at each end of the hinge section.

14. A drive-on dry dock as set forth in claim 9, wherein a plurality of transverse beam structures are positioned at spaced locations in the aft section.

15. A drive-on dry dock as set forth in claim 1, wherein the lift comprises a pair of inflatable devices positioned on either side of the path defined by the guide.

16. A drive-on dry dock as set forth in claim 1, wherein the lift comprises at least one inflatable device positioned below the aft section which is selectively inflatable/deflatable to move the platform between the first position and the second position.

17. A drive-on dry dock as set forth in claim 16, wherein the inflatable device is a pontoon having an inflation cavity connected to a fluid source.

18. A drive-on dry dock as set forth in claim 17, wherein the pontoon comprises an inner wall forming the inflation cavity, a corrugated outer wall surrounding the inner wall.

19. A method docking a boat longer than about thirty feet and weighing more than about seven thousand pounds on the dry dock set forth in claim 1, said method comprising the steps of:

placing the platform in its first position;

driving the boat onto the platform along the path defined by the guide surfaces to the rest position; and activating the lift to move the platform from the first position to the second position.

20. A drive-on dry dock especially suited for a boat longer than about thirty-eight feet and weighing more than about twelve thousand pounds; said dock comprising:

a platform including an aft section, a forward section, and hinge section which transversely hinges the aft section and the forward section together; and a pair of pontoons positioned below the aft section which are selectively inflatable/deflatable to shift the platform between a first state and a second state;

wherein, in the first state, a top surface of the forward section is generally coplanar and substantially above a mean water level and the aft section is slightly more than neutrally buoyant so that its top surface may be pressed downward to form a ramp along which the boat may be driven along a predetermined path to a rest position;

wherein, in the second state, the top surface of the aft section is above the mean water level and the boat is out of the water;

wherein the platform comprises a plurality of dock units assembled together in a rectangular array to form the aft section, the forward section and the hinged section;

wherein the dock units include buoyant units and non-buoyant units with at least some of the non-buoyant units being positioned in the aft section;

wherein the platform further comprises non-buoyant transverse beam structures positioned at either end of the hinge section; and wherein the pontoons each comprise an inner wall forming an inflation cavity connected to a fluid source, and an outer wall surrounding the inner wall and having corrugations extending therebetween forming a series of annular chambers.

21. A dock assembly for a water craft, said assembly comprising:

a plurality of dock units assembled together in a rectangular array of longitudinal rows and transverse rows to form a platform and defining seams between the units of each row; and a non-buoyant transverse beam structure for preventing transverse flexing of the platform;

wherein the transverse beam structure comprises a beam having a web extending into one of the transverse seams between transverse rows.

22. A dock assembly as set forth in claim 21, wherein the dock unit have a generally hollow main body and tabs extending from the main body for attaching each unit to one or more adjacent unit to form the rectangular array of units; the tabs spanning the seams between adjacent rows, fasteners through the tabs to connect them to the tabs of one or more adjacent units; and wherein the web extends into the seam to just below a bottom end of the fastener.

23. A dock assembly as set forth in claim 21, wherein the beam portion is an inverted T-beam portion.

24. A dock assembly as set forth in claim 23, wherein the transverse beam structure comprises other beam portions attached to the inverted T-beam portion.

* * * * *